US006402895B1

(12) United States Patent
Best

(10) Patent No.: US 6,402,895 B1
(45) Date of Patent: Jun. 11, 2002

(54) DEWATERING BELT, IN PARTICULAR DRYING SCREEN

(75) Inventor: Walter Best, Duren (DE)

(73) Assignee: Thomas Josef Heimbach Gesellschaft mit beschrankter Haftung & Co. (DE)

( * ) Notice: Subject to any disclaimer, the term of this patent is extended or adjusted under 35 U.S.C. 154(b) by 0 days.

(21) Appl. No.: 09/522,907

(22) Filed: Mar. 10, 2000

(30) Foreign Application Priority Data

Mar. 12, 1999 (EP) ..... 99104963

(51) Int. Cl.[7] ..... D21F 3/00

(52) U.S. Cl. ..... 162/358.2; 162/358.1; 162/900; 162/901; 162/902; 428/131; 428/137; 428/156; 428/222; 139/383 A; 442/33; 442/43; 442/62

(58) Field of Search ..... 162/358.2, 358.1, 162/900, 901, 902; 428/131, 137, 156, 152, 290, 247, 222; 139/383 A, 410; 442/43, 33, 58, 187, 203, 50, 220, 62

(56) References Cited

FOREIGN PATENT DOCUMENTS

| | | |
|---|---|---|
| DE | 3735709 | 5/1989 |
| WO | 9102642 | 3/1991 |

*Primary Examiner*—Peter Chin
*Assistant Examiner*—Mark Halpern
(74) *Attorney, Agent, or Firm*—Liniak, Berenato, Longacre & White, LLC

(57) ABSTRACT

The invention concerns a dewatering belt (1, 13, 17, 25, 30), in particular as a drying screen for paper machines, which is assembled from a plurality of plate-shaped planar elements (2, 14, 18, 24, 26, 27, 31, 32, 40) that, in order to adjust the permeability, have passthrough openings (41) and/or leave gaps (19, 36) between them, the planar elements (2, 14, 18, 24, 26, 27, 31, 32, 40) being coupled to one another, by way of flexible connecting cords (9, 16, 22, 23, 28, 37) which pass through the planar elements (2, 14, 18, 24, 26, 27, 31,. 32, 40), in such a way that the longitudinal forces acting on the dewatering belt (1, 13, 17, 25, 30) during operation act on them. The dewatering belt (1) is characterized in that the connecting cords (9, 16, 22, 23, 28, 37) extend in the longitudinal direction of the dewatering belt (1, 13, 17, 25, 30) and are anchored at their ends in end pieces (5, 6, 20, 29, 38) which can be coupled to one another.

20 Claims, 7 Drawing Sheets

1
2
3
4
5
6
7
8
9
10
11
12
A

DEWATERING BELT, IN PARTICULAR DRYING SCREEN

The invention concerns a dewatering belt, in particular as a drying screen for paper machines, which is composed of a plurality of plate-shaped planar elements that, in order to adjust the permeability, have passthrough openings and/or leave gaps between them, the planar elements being coupled to one another, by way of flexible connecting cords which pass through the planar elements, in such a way that the longitudinal forces acting on the dewatering belt during operation act on them.

A dewatering belt of this kind is evident from DE 37 35 709 A1. This dewatering belt comprises a plurality of planar elements that are configured as elongated planar strips extending in the transverse direction, which are arranged one behind the other in the longitudinal direction of the dewatering belt and are coupled to one another by transversely extending inserted wires. For this purpose, the planar elements engage alternately into one another so as to create lined-up passages into which the inserted wires can be slid.

A dewatering belt of this kind has considerable advantages. The plate-shaped planar elements can be easily and quickly manufactured by injection molding or by extrusion methods. By combining them, it is possible to fabricate dewatering belts in almost any desired length and width. Permeability in the thickness direction can be precisely and reproducibly adapted to particular requirements with the aid of defined passthrough openings in the planar elements themselves and/or by providing gaps between the planar elements. Despite these passthrough openings and/or gaps, the paper web is supported over a large area, so that practically no marks are created on the paper web. There is also a great deal of freedom in terms of the thickness of the planar elements, i.e. they can be adapted to the particular machine requirements. A corresponding freedom exists in terms of selecting the material for the planar elements. Plastics, such as thermoplastics, thermosetting plastics, and cast resins, are suitable therefor. The planar elements can, however, also be manufactured from elastomers or even metals. It is also conceivable in this context not to manufacture all the planar elements of a dewatering belt from the same material, so that different materials can be provided in alternation.

As this type of dewatering belt has been developed, it has been found that a tensile strength sufficient for all applications could not be achieved, especially if the planar elements are manufactured from plastic. Even reinforcements of the injection-molded planar elements with glass fibers or the like provided little remedy.

It is thus the object of the invention to configure a dewatering belt of the kind cited initially in such a way that it is suitable for absorbing large tensile forces in the longitudinal direction of the dewatering belt.

According to the present invention, this object is achieved in that the connecting cords extend in the longitudinal direction of the paper machine cloth and are anchored at their ends in end pieces which can be coupled to one another. The fundamental idea of the invention is consequently to absorb the longitudinal forces occurring on the dewatering belt during operation by way of connecting cords extending in the longitudinal direction. It has been found that substantially greater longitudinal forces can be absorbed in this manner than in the dewatering belt according to the existing art, adaptation to the particular requirements being made possible by appropriate selection of the nature, cross section, and material of the connecting cords.

The connecting cords can be configured, for example, as monofilaments, monofilament twisted yarns, untwisted bundles of monofilaments, flat or oval ribbons, or the like; these kinds of connecting cords can also be braided, woven, or knitted. They can also be coated. Suitable materials are, in particular, PET, PPS, PEK, PEEK, polysulfone, PEN, thermoplastic aromatic PA, and even steel. The connecting cords should always be at least as thermally and chemically resistant as the planar elements themselves.

Anchoring of the connecting cords in the end pieces can be accomplished in various ways, for example by welding, adhesive bonding, pressing, or even looping. The end pieces can be configured as individual pieces into which only one connecting cord, or a few of them, is or are anchored. They can also, however, be configured as end strips into which a plurality of connecting cords are anchored; the end strips can also extend over the entire width of the dewatering belt. The dewatering band can easily be closed by way of the end pieces. In this case each two end pieces form a seam.

It is possible in principle to assemble a dewatering belt from a plurality of portions, each portion having at its ends end pieces that are coupled to end pieces of the subsequent portion. In general, however, the connecting cords will be allowed to extend over the entire length of the dewatering belt, so that only one seam is created.

In a further embodiment of the invention, provision is made for the planar elements to have at least two connecting cords passing through them, so that they can be properly guided in the belt plane and cannot tilt. The planar elements should preferably form transverse rows offset from one another, the connecting cords extending in such a way that they pass through mutually offset planar elements of adjacent transverse rows. This type of crosslinking imparts stability to the dewatering belt, especially in the transverse direction.

The planar elements can be of largely unrestricted configuration in terms of their geometrical contouring. In principle, they should possess geometric shapes that can complement one another in jigsaw-puzzle fashion; the planar elements can, but need not, be identical to one another. Shapes suitable for this purpose are, in particular, rectangles, but also polygons (e.g. regular hexagons or cross-shaped planar elements), which can have rounded corners.

Deviating from the geometries just described, the planar elements can also be configured as planar bars, several of which are in each case arranged next to one another in the transverse direction of the dewatering belt to form a transverse row, the planar bars of two adjacent transverse rows being arranged so that the gaps of the one transverse row of planar bars are bridged by planar bars of the other transverse row.

The material for the planar elements, like that of the connecting cords, should be adapted to particular requirements. For an application as a drying screen, heat-resistant materials such as PET, PPS, PEK, PEEK, polysulfone, PEN, thermoplastic aromatic PA, and metals such as steel or light alloys are especially suitable. If plastics are used, the planar elements can be manufactured using the injection-molding method.

The planar elements moreover can also have conformations such as those already described in DE 37 35 709 A1, i.e. they can also extend over the entire width of the dewatering belt and/or can be configured as hollow elements in order to save material and therefore weight. In this context, the hollow element configuration need not be closed, and for example can be such that the cavities communicate with one another in the transverse and/or longitudinal belt direction. Desired materials can be embedded in these cavities. The planar elements can also comprise a rigid inner support part and a plastic outer sheath surrounding it, i.e. can be of layered configuration. Different materials can also be provided for the outer and inner sides of the dewatering belt. In addition, laminated or vacuum-deposited films can also be provided, for example in order to reflect thermal radiation. Flock coatings or a coating with foam material or nonwoven fiber can also be performed.

In principle, there exists the possibility of lining up the planar elements loosely on the connecting cords, such that the connecting cords pass through corresponding passthrough holes in the planar elements. They can, however, also be joined to the connecting cords, for example adhesively bonded or hot- or cold-pressed.

According to a further feature of the invention, provision is made for the planar elements to have bending hinges in the transverse direction of the dewatering belt so that they can better adapt to deflection rollers, especially if they are relatively large in area. One planar element can also have several such bending hinges. The bending hinges can be constituted by correspondingly thinning the material cross section.

Provision is also made according to the invention for the end pieces to have loop-like passages through which, in the aligned position, a coupling wire can be inserted.

The invention furthermore proposes that the end pieces have flow-enabling passthrough openings in order to adapt the permeability of the dewatering belt, in particular for steam, in the region of the end pieces to that in the other regions, where the permeability is controlled on the basis of passthrough openings in the planar elements and/or by way of gaps between them.

Lastly, the invention provides for end pieces and/or planar elements to be assembled from two complementary halves which enclose the connecting cords between them. For this purpose, the halves should have half-channels on the mutually facing sides to receive the connecting cords. The halves are placed on either side of the connecting cords and then joined to one another. The joint can be accomplished using adhesive or heat-sealing. It is also possible, however, to provide coupling elements which engage into one another and snap-lock.

The invention is illustrated in more detail, with reference to exemplary embodiments, in the drawings, in which.

Figure 1:
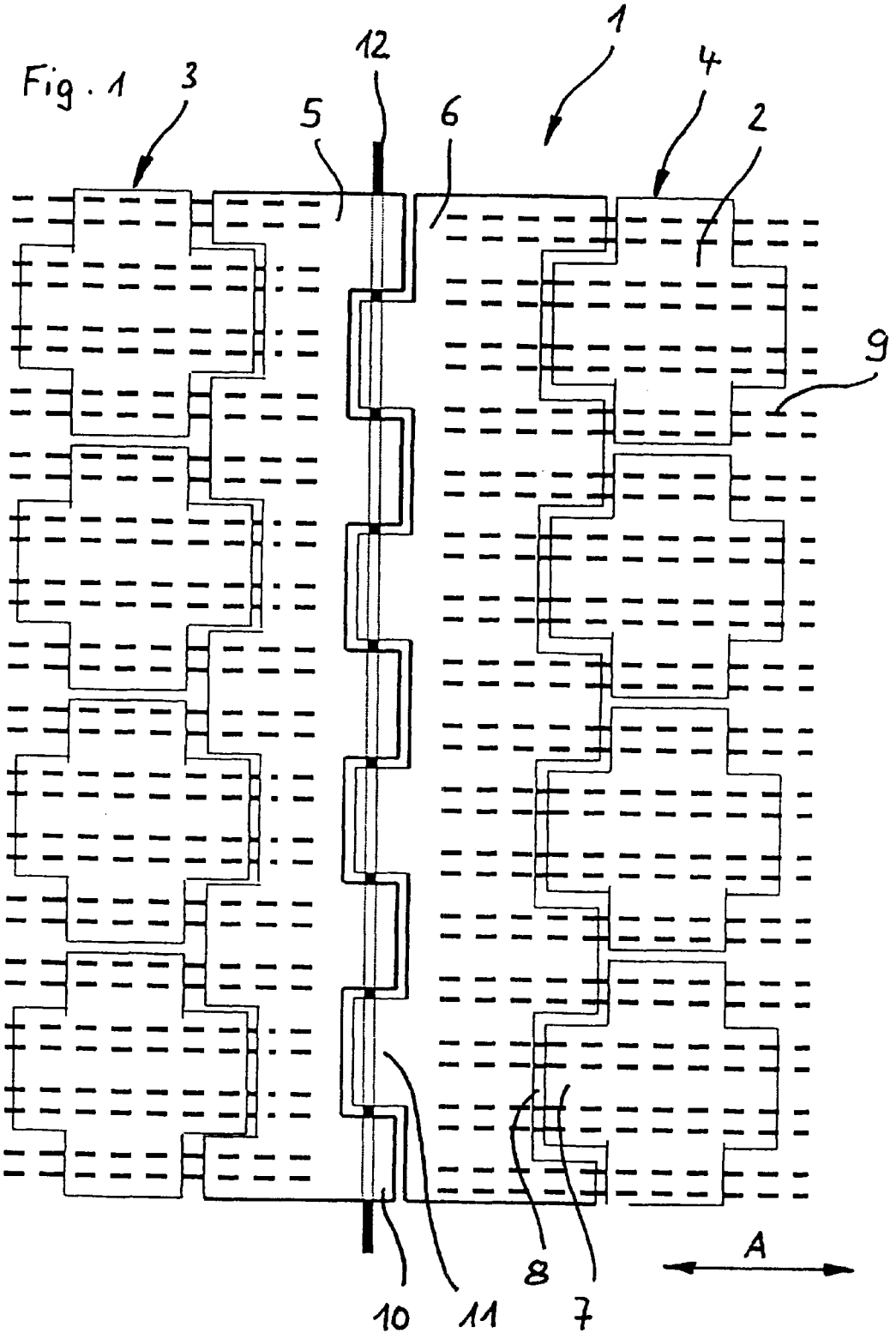
FIG. 1 shows a plan view of the seam region of a drying screen according to the invention.

Drying screen 1 depicted in FIG. 1 is assembled from a plurality of cross-shaped planar elements (labeled 2 by way of example). Planar elements 2, partially visible, form respective transverse rows 3, 4 of planar elements 2 arranged next to one another in the transverse direction, the respective subsequent rows in the longitudinal direction (arrow A) being omitted. The subsequent transverse rows are offset by half the width of planar elements 2 with respect to transverse rows 3, 4 that are shown, so that these rows fit in jigsaw-puzzle fashion into transverse rows 3, 4 that are shown, as is evident from the example shown in FIG. 2.

Two end strips 5, 6, which extend over the entire width of drying screen 1, are provided between transverse rows 3, 4. The edges of end strips 5, 6 adjacent to transverse rows 3, 4 are toothed in such a way that they are adapted to the conformation of planar elements 2, specifically such that the webs (labeled 7 by way of example) projecting in the longitudinal direction fit into recesses (labeled 8 by way of example) in end strips 5, 6.

In end strips 5, 6, the ends of thirty-two connecting cords (labeled 9 by way of example) are immovably anchored by having been inserted into corresponding holes and then press-fitted and/or adhesively bonded. Connecting cords 9 form respective pairs, and run parallel in the longitudinal direction (arrow A). Connecting cords 9 extend from end plate 5 to end plate 6 over the entire length of drying screen 1, passing through passthrough holes in planar elements 2 extending in the belt plane, specifically eight connecting cords 9 per planar element 2. Because of the offset of planar elements 2, the portion of connecting cords 9 that passes through the center region of planar elements 2 in rows 3, 4 that are shown runs, in the planar elements (not visible here) of the respective subsequent rows, through their edge webs, while conversely connecting cords 9 passing, in rows 3, 4 that are depicted, through the edge webs of planar elements 2 pass through the center region of planar elements 2 of the subsequent planar elements (not visible here).

End strips 5, 6 each have loop flanges (labeled 10, 11 by way of example) which are offset from one another in the transverse direction in such a way that in the coupled state shown, they overlap in toothed fashion. Loop flanges 10, 11 have passthrough holes, running in the transverse direction, which line up in the coupled state and have an inserted coupling wire 12 passing through them. The ends of drying screen 1 are coupled by way of this inserted coupling wire 12. The thickness of end strips 5, 6 is the same in all regions, i.e. loop flanges 10, 11 also have the same thickness as the other regions of end strips 5, 6.

Figure 2:
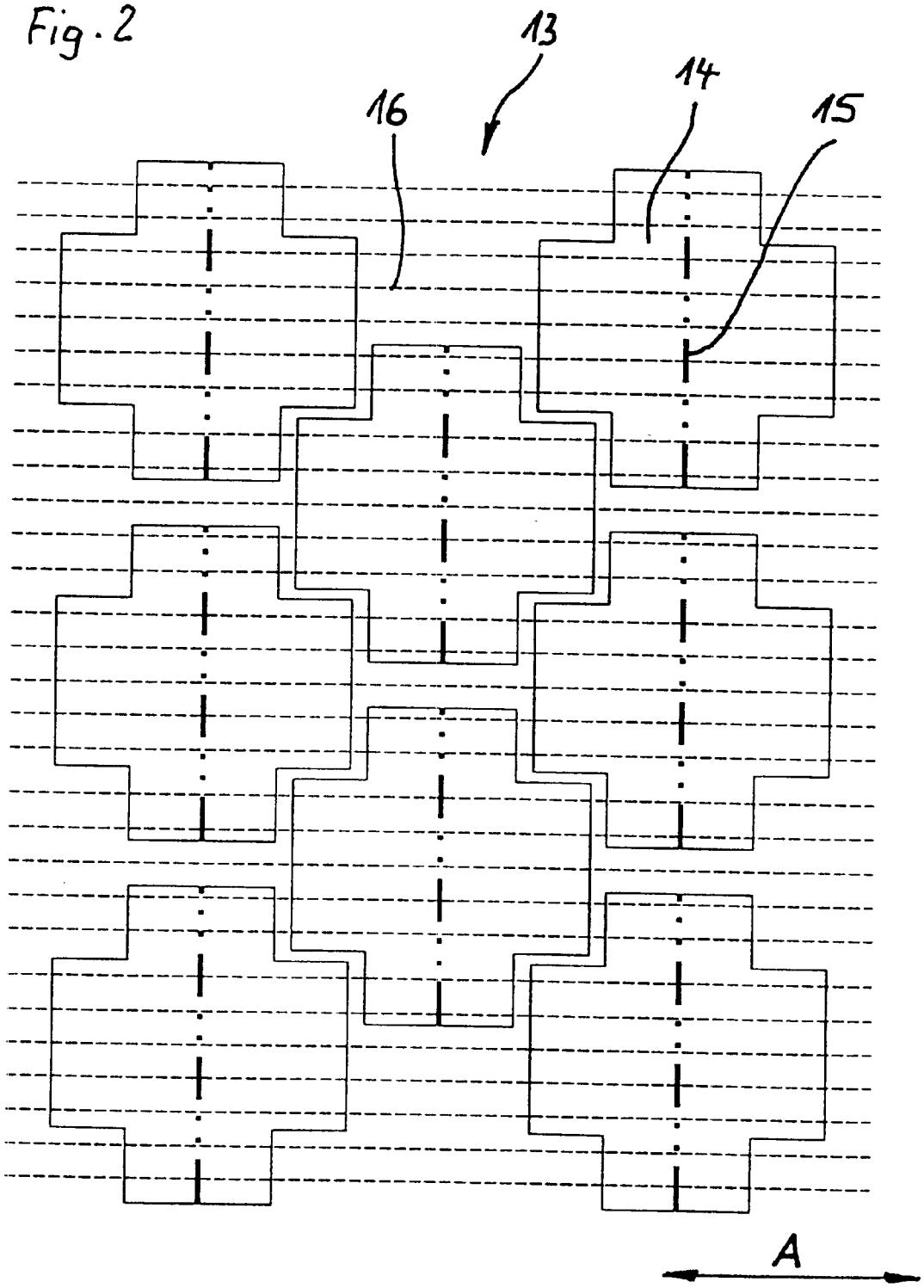
FIG. 2 shows a plan view of a portion of a further drying screen with planar elements that have bending hinges.

FIG. 2 shows a portion of another drying screen 13. It differs from drying screen 1 as shown in FIG. 1 only in that the planar elements (labeled 14 by way of example), which here are also of cross-shaped configuration, have in the middle a bending joint (labeled 15 by way of example) extending in the transverse direction of drying screen 13. This allows drying screen 13 to conform better when curving around rollers. The flexibility in the region of bending joint 15 can be brought about by correspondingly decreasing the thickness of planar element 14 in this region. Since tensile forces do not act on planar elements 14, but instead are absorbed by the connecting cords (labeled 16 by way of example), this thinning of planar elements 14 has no effect on the tensile strength of drying screen 13.

Figure 3:
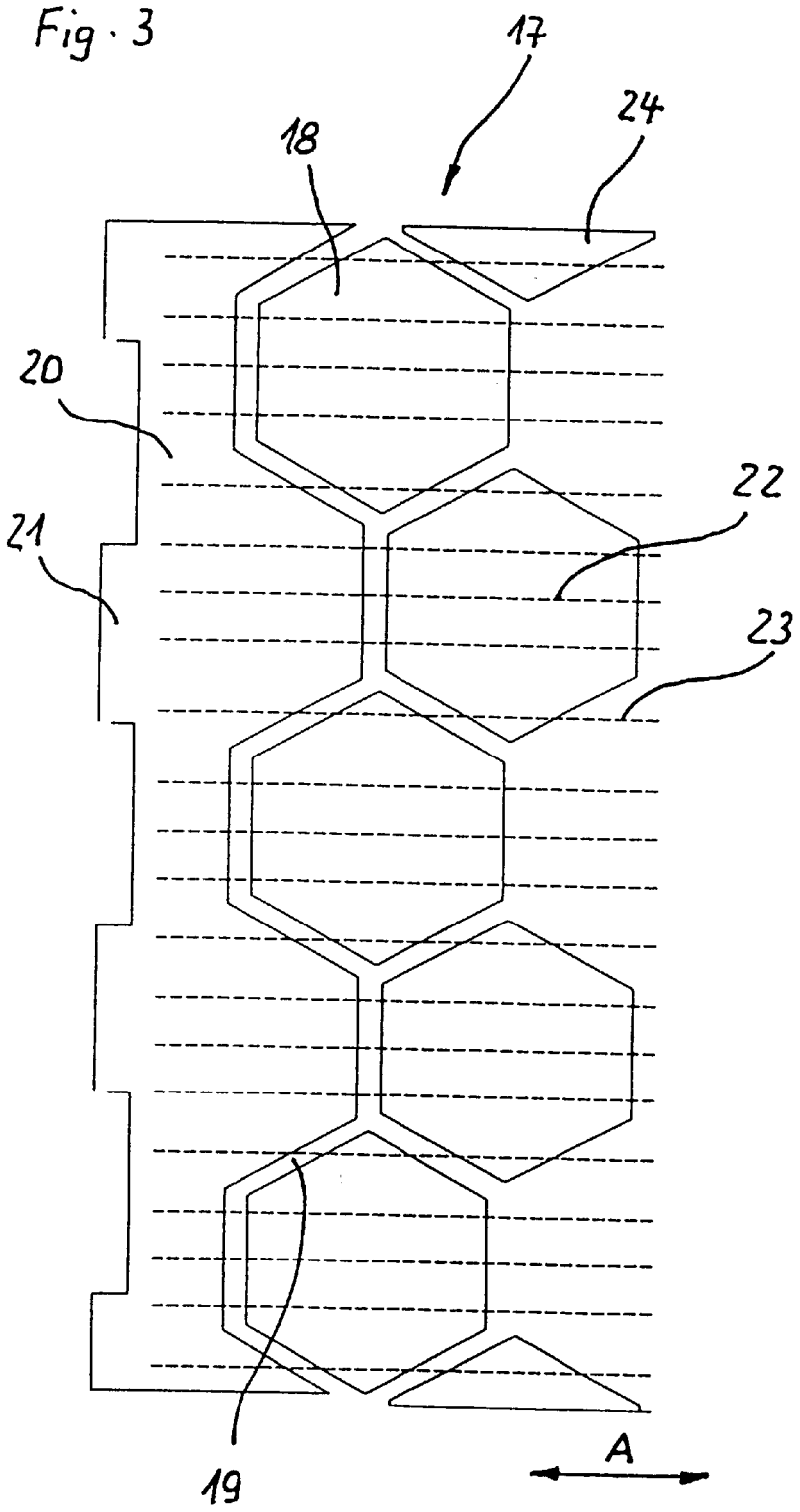
FIG. 3 shows a plan view of an end region of a third drying screen according to the invention.

The exemplary embodiment of a drying screen 17 depicted in FIG. 3 has planar elements (labeled 18 by way of example) which are not cross-shaped as in the case of the exemplary embodiments of FIGS. 1 and 2, but rather hexagonal, these planar elements 18 being arranged so that in each case two of their edges extend transversely to the longitudinal direction (arrow A). Here again, planar elements 18 are arranged in jigsaw-puzzle fashion, resulting in gaps (labeled 19 by way of example) between them which everywhere have the same width. One end strip 20, which is equipped with loop flanges (labeled 21 by way of example), is correspondingly adapted. It can therefore, in the same manner as with the exemplary embodiment shown in FIG. 1, be coupled to a complementarily configured end strip at the other end of drying screen 17.

The ends of connecting cords (labeled 20 by way of example) which extend from end strip 20 shown here to the other end strip (not depicted) are anchored in end strip 20. Each planar element 18 is press-fitted onto—i.e. immovably joined to—five of these connecting cords 20. One of the connecting cords (labeled 23 by way of example) passes in each case through the edge region on one side of a planar element 18 and then the edge region on the other side of a subsequent planar element 18 offset transversely to the first. The arrangement of planar elements 18 is thereby stabilized in the transverse direction.

Appropriate triangular planar elements (labeled 24 by way of example) are provided on both edges of drying screen 17 in order to straighten it. Connecting cords 23 pass through them as well. It is understood that gap-filling planar elements 24 at the edges can also be provided in the case of the exemplary embodiments of FIGS. 1 and 2.

Figure 4:
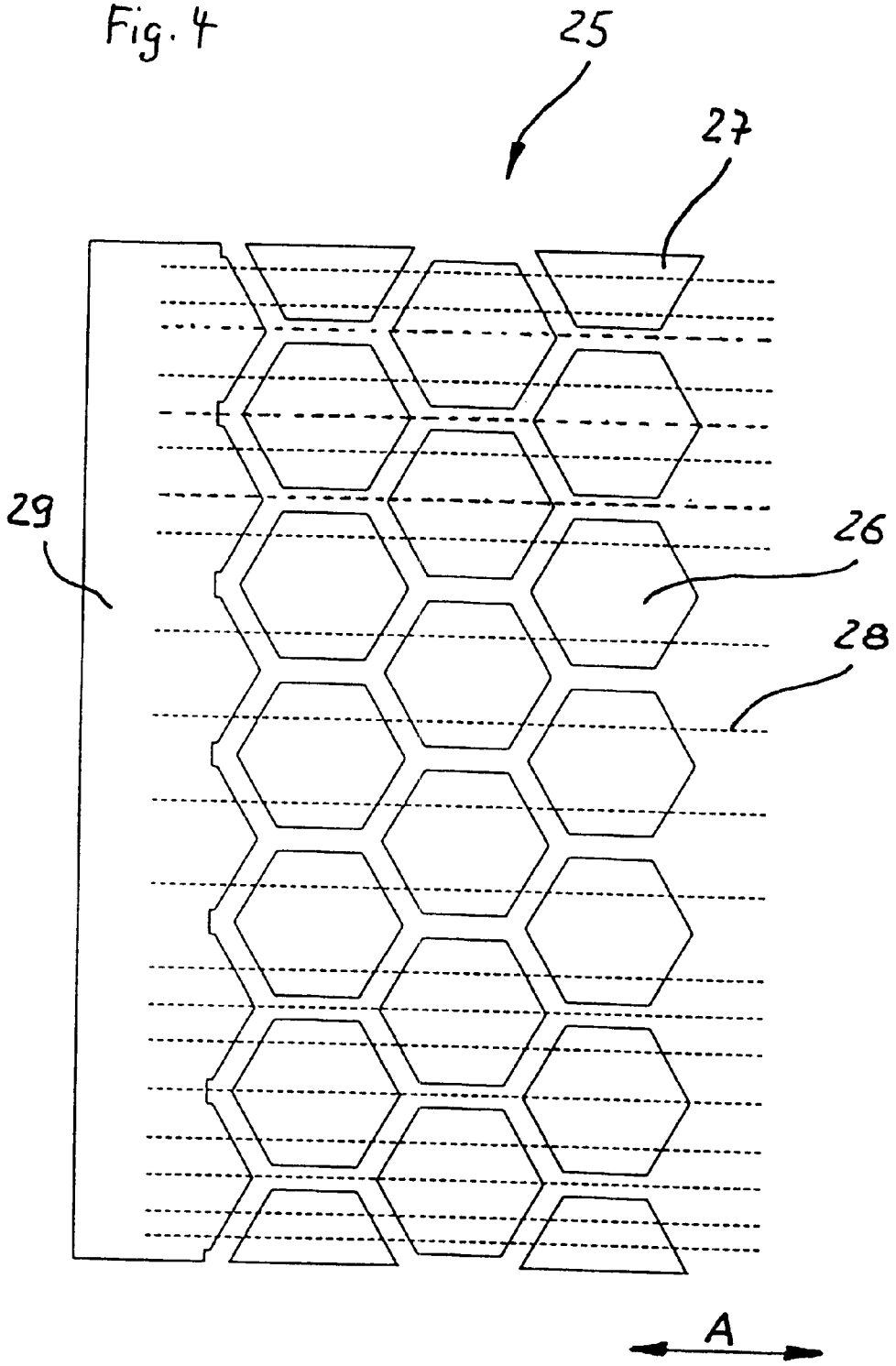
FIG. 4 shows a plan view of the end region of a fourth drying screen.

The exemplary embodiment depicted in FIG. 4 of a drying screen 25 is also made up of regular hexagonal planar elements (labeled 26 by way of example). Here, however, planar elements 26 are arranged with a 30° rotation as compared to the exemplary embodiment shown in FIG. 3, so that in each case two opposite edges extend in the longitudinal direction (arrow A) of drying screen 25. Here again, planar elements (labeled 27 by way of example) are provided on the edges, ensuring a straight edge termination and filling up the gaps located there. On both edges of drying screen 25, the density of the connecting cords (labeled 28 by way of example) is increased in order to ensure particularly good transverse stability in that region. Another result of this is that the trapezoidal planar elements 27 at the edges each have two connecting cords 28 passing through them, thus preventing them from tilting about their longitudinal axis. Here as well, connecting cords 28 are anchored in an end strip 29, which has a straight termination at its free end but can be equipped with loop flanges in the same way as in the exemplary embodiments described above.

Figure 5:
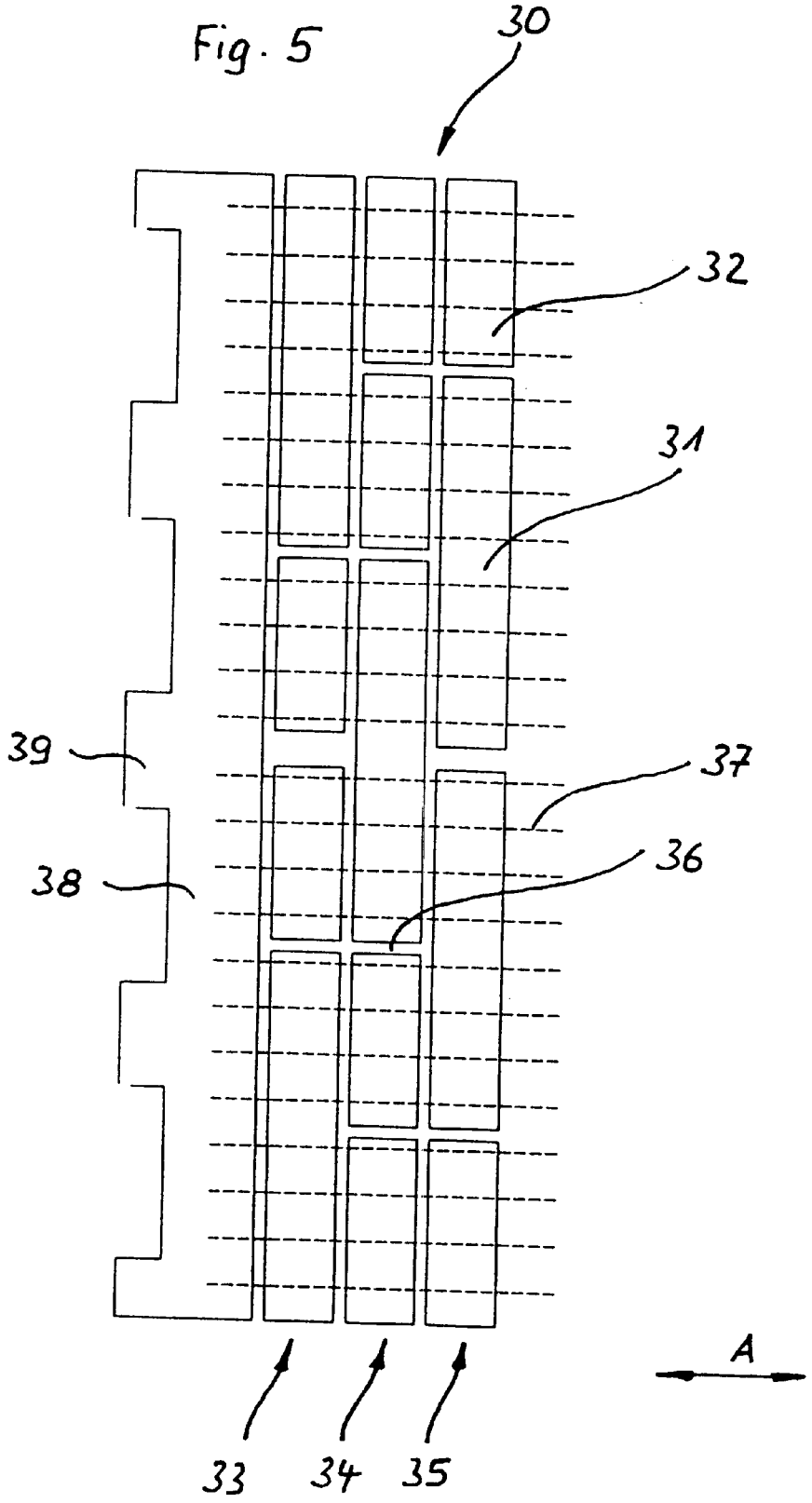
FIG. 5 shows a plan view of the end region of a fifth drying screen.

FIG. 5 depicts a further exemplary embodiment of a drying screen 30, specifically one of its end regions. Drying screen 30 is assembled from rectangular, bar-like planar elements (labeled 31 and 32 by way of example), planar elements 31, 32 forming transverse rows 33, 34, 35. Each transverse row 33, 34, 35 is assembled from long planar elements (labeled 31 by way of example) and short planar elements (labeled 32 by way of example), thus yielding transverse rows 33, 34, 35 of identical length, and straight side edges for drying screen 30. Planar elements 31, 32 are arranged differently in each transverse row 33, 34, 35, thus creating gaps (labeled 36 by way of example) between planar elements 31, 32 in each transverse row 33, 34, 35. Planar elements 31, 32 are distributed in such a way that gaps 36 in one transverse row 33, 34, 35 are bridged by a planar element 31, 32 at least in one adjacent transverse row 33, 34, 35. Since short planar elements 32 have four connecting cords (labeled 37 by way of example) passing through them, and long planar elements 31 have eight connecting cords 37 passing through them, the result is a kind of crosslinking of planar elements 31, 32 to one another, and thus mutual transverse stabilization.

Here as well, connecting cords 37 are again anchored in an end strip 38 with loop flanges (labeled 39 by way of example). In the same fashion as with the exemplary embodiments shown in FIGS. 1 through 3, end strip 38 can be coupled to a complementary end strip at the other end of drying screen 30.

FIGS. 6 through 13 show cross-shaped planar elements of identical size, all labeled 40. They differ in that they have passthrough holes (labeled 41 by way of example) of different geometrical shapes.

Figure 6:
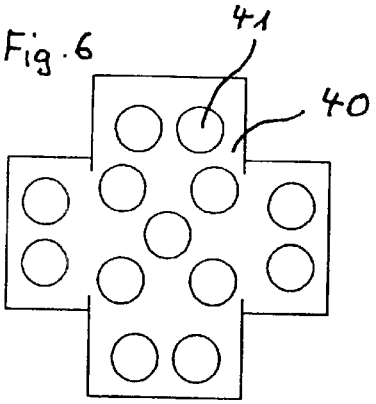
FIGS. 6 through 13 show various examples of cross-shaped planar elements having passthrough openings.
Figure 7:
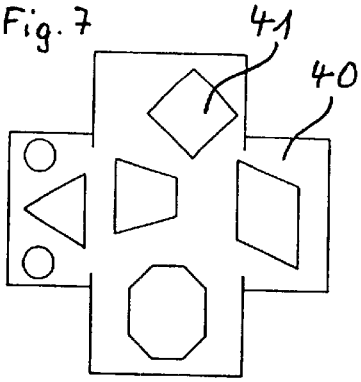
Figure 8:
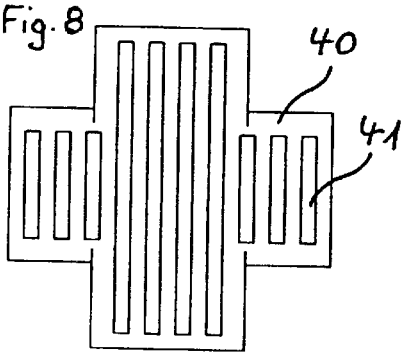
Figure 9:
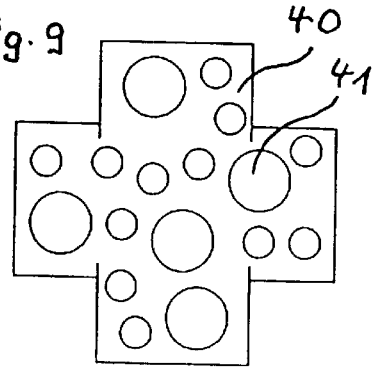
Figure 10:
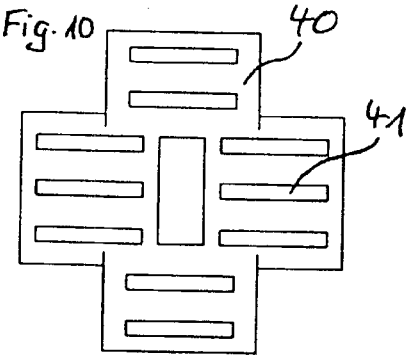
Figure 11:
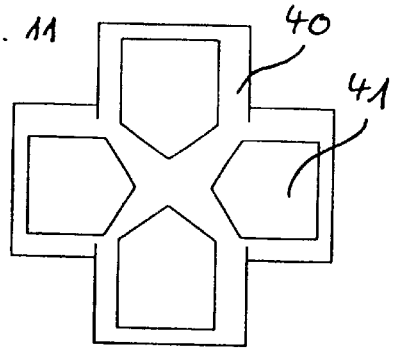
Figure 12:
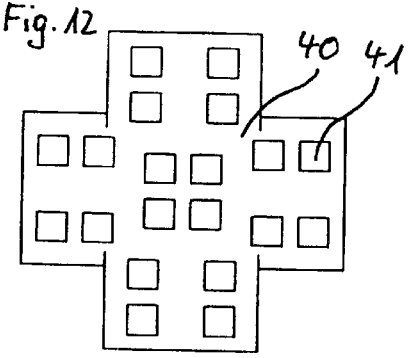
Figure 13:
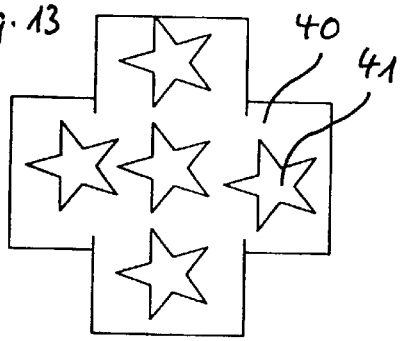

In FIG. 6, planar element 40 has circular passthrough holes 41 of identical diameter. Planar element 40 as shown in FIG. 7 has round, triangular, trapezoidal, square, parallelogram-shaped, and octagonal passthrough holes 41. In planar element 40 as shown in FIG. 8, rectangular passthrough holes 41 are provided in a parallel arrangement. In the exemplary embodiment shown in FIG. 9, planar element 40 once again has circular passthrough holes 41 but of different diameters. The exemplary embodiment according to FIG. 10 has rectangular passthrough holes 41 in a parallel arrangement, a rectangular passthrough hole 41 running perpendicularly thereto being provided in the center. In FIG. 11, planar element 40 has pentagonal passthrough holes 41, and in FIG. 12 square passthrough holes 41 in a regular arrangement. The exemplary embodiment according to FIG. 13 contains star-shaped passthrough holes 41.

It is understood that in order to adjust the permeability of a drying screen, any other desired embodiments and arrangements of passthrough holes 41 may also be suitable; planar elements 40 from which a drying screen is assembled do not need to be of identical configuration, but rather can possess different types of passthrough holes 41 in order to create (local) differences in the permeability of the drying screen.

Figure 14:
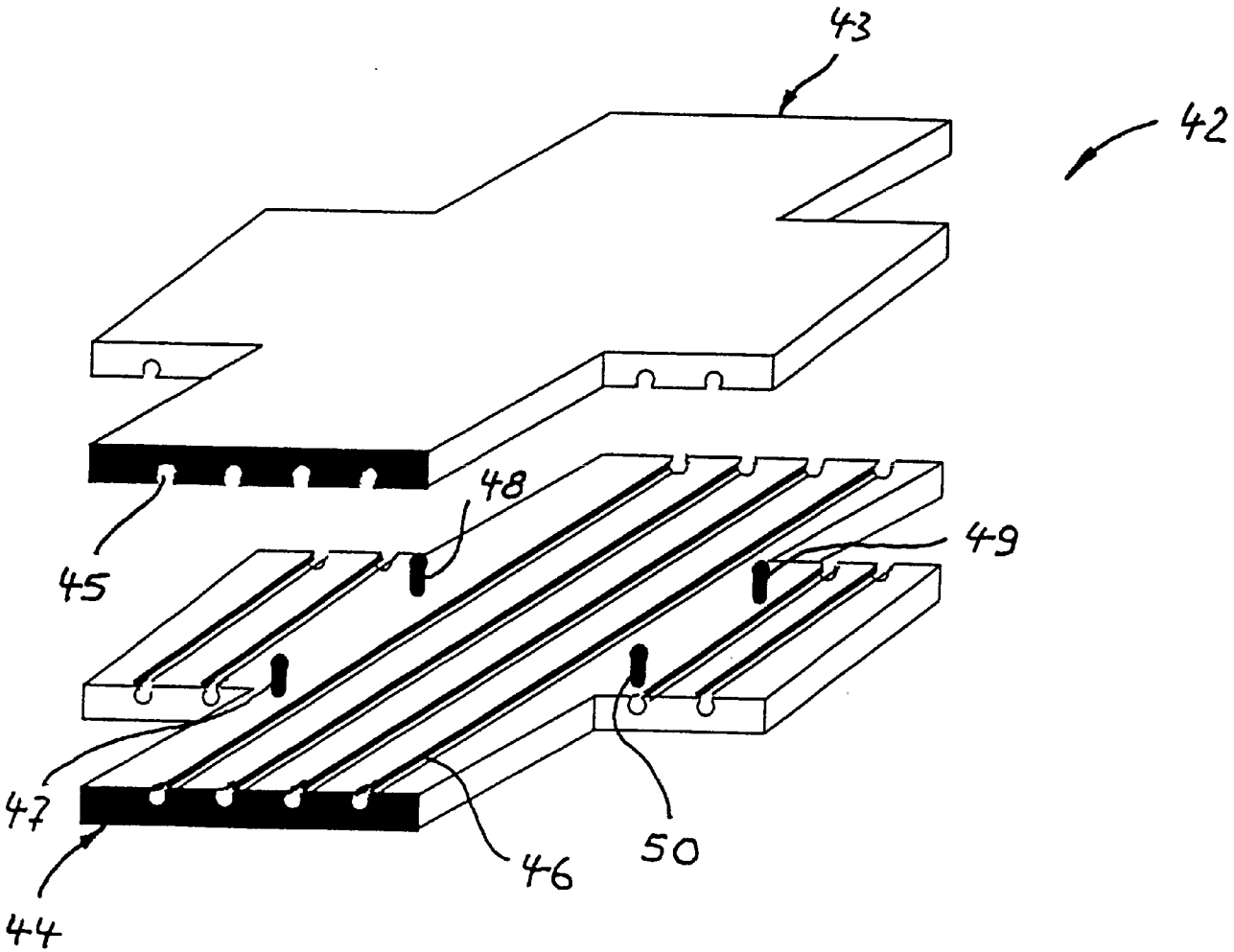
FIG. 14 shows a two-part planar element.

FIG. 14 depicts a further cross-shaped planar element 42 in perspective. It comprises two complementary planar element halves 43, 44, which are depicted at a spacing from one another and which have half-channels (labeled 45 and 46 by way of example) on the mutually facing sides.

Lower planar element half 44 has four coupling pins 47, 48, 49, 50 that project vertically from the side facing upper planar element half 43. Upper planar element 43 has matching receiving orifices (not visible here), coupling pins 47, 48, 49, 50 and the receiving orifices being configured such that the two snap-lock to one another when planar element halves 43, 44 are placed onto one another.

To assemble planar element 42, planar element halves 43, 44 are laid from either side onto the longitudinal cords (not depicted here) in such a way that they can be received in half-channels 45, 46. When planar element halves 43, 44 are pressed together, half-channels 45, 46 complement one another to form complete channels receiving the longitudinal cords; coupling pins 47, 48, 49, 50 and the receiving orifices ensure that planar element 42 is securely held on the longitudinal cords by frictional engagement.

What is claimed is:

1. A dewatering belt (1, 13, 17, 25, 30) for paper machines, which is assembled from a plurality of plate-shaped planar elements (2, 14, 18, 24, 26, 27, 31, 32, 40) that have passthrough openings (41) and/or gaps (19, 36) between said elements in order to control permeability of the belt, the planar elements (2, 14, 18, 24, 26, 27, 31, 32, 40) being coupled to one another by flexible connecting cords (9, 16, 22, 23, 28, 37) which pass through the planar elements (2, 14, 18, 24, 26, 27, 31, 32, 40), in such a way that longitudinal forces acting on the dewatering belt (1, 13, 17, 25, 30) during operation of the paper machine act on the planar elements, wherein the connecting cords (9, 16, 22, 23, 28, 37) extend in the longitudinal direction of the dewatering belt (1, 13, 17, 25, 30) and are anchored at respective ends in end pieces (5, 6, 20, 29, 38) which are adapted to be coupled together.

2. The dewatering belt as defined in claim 1, wherein the end pieces are configured as end strips (5, 6, 20, 29, 38).

3. The dewatering belt as defined in claim 2, wherein the end strips (5, 6, 20, 29, 38) extend over the entire width of the dewatering belt (1, 13, 17, 25, 30).

4. The dewatering belt as defined in claim 1, wherein the connecting cords extend over the entire length of the dewatering belt (1, 13, 17, 25, 30).

5. The dewatering belt as defined in claim 1, wherein the planar elements (2, 14, 18, 26, 27, 31, 32, 40) have at least two connecting cords (9, 16, 22, 23, 28, 37) passing through them.

6. The dewatering belt as defined in claim 1, wherein the planar elements (2, 14, 18, 26, 27, 40) form transverse rows (3, 4) offset from one another, the connecting cords (9, 16, 22, 23, 28) extending in such a way that they pass through mutually offset planar elements (2, 14, 28, 26) of adjacent transverse rows.

7. The dewatering belt as defined in claim 1, wherein the planar elements (2, 14, 18, 26, 27, 31, 32, 40) have geometric shapes that complement one another in jigsaw-puzzle fashion.

8. The dewatering belt as defined in claim 1, wherein the planar elements (2, 14, 18, 26, 27, 31, 32, 40) are configured as polygons, in particular as regular hexagons.

9. The dewatering belt as defined in claim 1, wherein the planar elements (2, 14, 40) are of cross-shaped configuration.

10. The dewatering belt as defined in claim 1, wherein planar elements are configured as planar bars (31, 32), several of which are in each case arranged next to one another in the transverse direction of the dewatering belt (30) to form a transverse row (33, 34, 35), the planar bars (31, 32) of two adjacent transverse rows (33, 34, 35) being arranged so that the gaps (36) of the one transverse row (33, 34, 35) are bridged by planar bars (31, 32) of the other transverse row (33, 34, 35).

11. The dewatering belt as defined in claim 1, wherein the planar elements are lined up loosely on the connecting cords.

12. The dewatering belt as defined in claim 1, wherein the planar elements (2, 14, 18, 24, 26, 27, 31, 32, 40) are adhesively bonded or press-fitted to the connecting cords (9, 16, 22, 23, 28, 37).

13. The dewatering belt as defined in claim 1, wherein planar elements (14) have bending hinges (15) extending in the transverse direction of the dewatering belt (13).

14. The dewatering belt as defined in claim 1, wherein the end pieces (5, 6, 20, 38) have loop-like passages through which, in the aligned position a coupling wire (12) can be inserted.

15. The dewatering belt as defined in claim 1, wherein the end pieces have flow-enabling passthrough openings.

16. The dewatering belt as defined in claim 1, wherein the end pieces are assembled from two complementary halves (43, 44) which enclose the connecting cords between them.

17. The dewatering belt as defined in claim 16, wherein the halves (43, 44) have half-channels (45, 46) on the mutually facing sides to receive the connecting cords.

18. The dewatering belt as defined in claim 16, wherein the halves (43, 44) have coupling elements (47, 48, 49, 50) that engage into one another and thus join the halves (43, 44).

19. The dewatering belt as defined in claim 16, wherein the halves (43, 44) are joined to one another by heat-sealing or adhesive bonding.

20. The dewatering belt as defined in claim 1, wherein the planar elements are assembled from two complementary halves (43, 44) which enclose the connecting cords between them.

* * * * *